United States Patent [19]

Derain

[11] Patent Number: 4,824,405

[45] Date of Patent: Apr. 25, 1989

[54] SELF-LOCKING ELECTRICAL BANANA PLUG

[76] Inventor: Ronald Derain, 66 Boyd Avenue, Weston, Ontario, Canada, M9N 2C9

[21] Appl. No.: 55,146

[22] Filed: May 28, 1987

[51] Int. Cl.[4] ..... H01R 13/639

[52] U.S. Cl. ..... 439/807; 439/811; 439/825; 439/836

[58] Field of Search ..... 439/324, 801, 807, 810, 439/811, 825–827, 835–838, 863

[56] References Cited

U.S. PATENT DOCUMENTS

| | | | |
|---|---|---|---|
| 2,851,669 | 9/1958 | Koch | 439/801 |
| 3,252,127 | 5/1966 | Woodward | 339/217 |
| 3,894,785 | 7/1975 | Hubner et al. | 339/252 |
| 4,169,654 | 10/1979 | Plyler et al. | 339/252 |
| 4,384,758 | 5/1983 | Lee et al. | 439/801 |
| 4,416,504 | 11/1983 | Sochor | 339/252 |
| 4,447,110 | 5/1984 | Punako | 339/252 |
| 4,468,083 | 8/1984 | Lee et al. | 339/252 |
| 4,526,429 | 7/1985 | Kirkman | 339/17 |

FOREIGN PATENT DOCUMENTS

| | | | |
|---|---|---|---|
| 842414 | 5/1970 | Canada | 339/59 |
| 1055582 | 5/1979 | Canada | 339/59 |
| 1128157 | 7/1982 | Canada | 339/59 |
| 1153438 | 9/1983 | Canada | 339/60 |
| 2447623 | 8/1980 | France . | |
| 232384 | 4/1925 | United Kingdom | 439/813 |

*Primary Examiner*—John McQuade

*Attorney, Agent, or Firm*—Lewis H. Eslinger; Jay H. Maioli

[57] ABSTRACT

A self-locking electrical banana plug comprising a main body member having an expandable plug at one end and expansion means operable to expand the plug at the other end, and means for receiving and clamping an electrical conductor to the body member, the expansion means, in operation, concomitantly expanding the plug and clamping the conductor.

16 Claims, 3 Drawing Sheets

SELF-LOCKING ELECTRICAL BANANA PLUG

This invention relates to a self-locking electrical banana plug which has particular, but not exclusive, use in the connection or interconnection of television, audio and computer apparatuses.

In commercial television, audio and computer operations and to a lesser extent in domestic equipment of similar types, it is often desirable or essential to interconnect apparatuses in a highly reliable manner. This is particularly so in studios, control rooms and transmitter low-power connections where inadequate interruptions cannot be tolerated. In outside broadcast units, both television and audio, oftentimes interconnect cables are loosely strung and subject to accidental disconnections by careless operators and possible strong winds, etc. All the foregoing discussion applies equally to computers or field research or experimental equipment, such as geodesic exploration, etc., etc.

It is, therefore, a feature of one aspect of the invention to provide an electrical banana plug which, after insertion in an associated receptacle or jack, may be positively locked in position.

It is a feature of another aspect of the invention to provide a further means whereby an electrical conductor may be terminated with the above-mentioned banana plug, but wherein the said further means is effected concomitantly with the positive locking of the banana plug.

Figure 1:
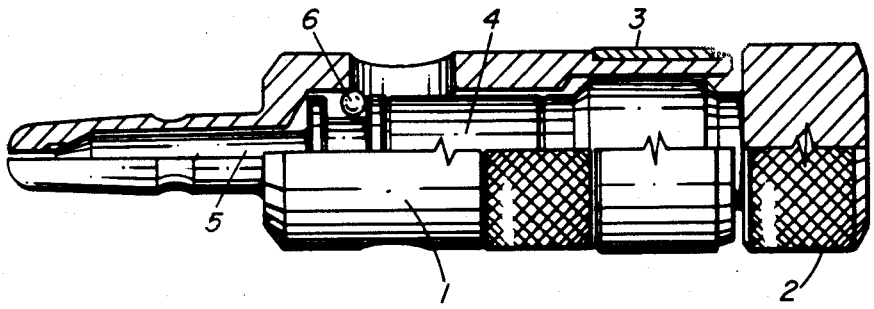

A preferred embodiment of the invention will now be described with reference to the following drawings in which:

FIG. 1 is a side view, partly in section, of the fully assembled banana plug.

Figure 2A:
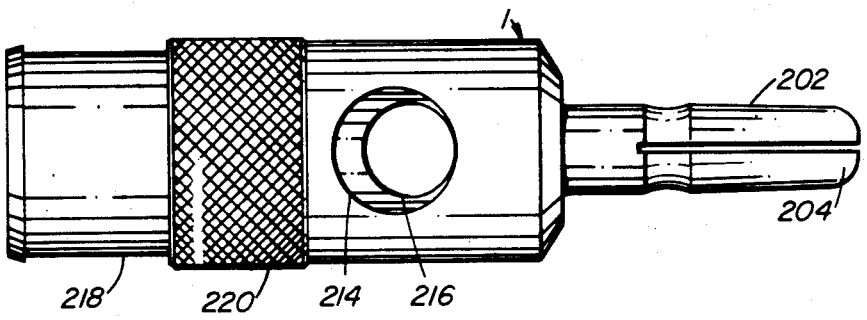
Figure 2B:
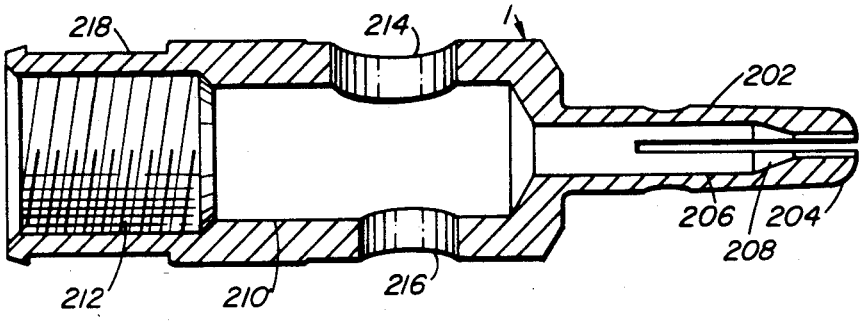
Figure 2C:
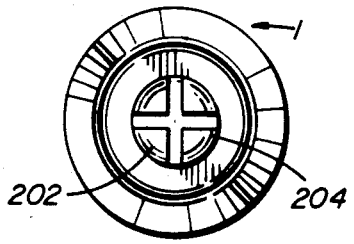

FIGS. 2*a*, 2*b* and 2*c* are, respectively, a top view, a side view (in section), and an end view of the main body portion of the plug shown in FIG. 1.

Figure 3A:
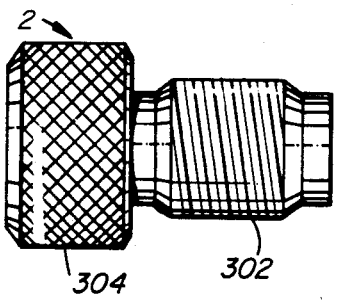
Figure 3B:
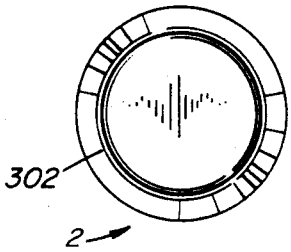

FIGS. 3*a* and 3*b* are, respectively, a side view and an end view of the locking screw of the banana plug.

Figure 4A:
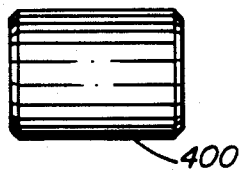
Figure 4B:
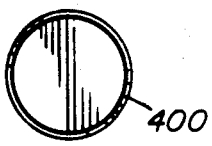
Figure 5A:
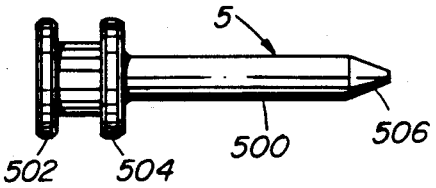
Figure 5B:
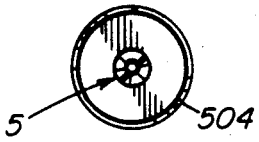

FIGS. 4*a* and 4*b* are, respectively, a side view and an end view of a contact plug within the banana plug; and FIGS. 5*a* and 5*b* are, respectively, a side view and an end view of a locking plunger within the banana plug.

Referring to FIG. 1, the electrical self-locking banana plug comprises a main body member 1, a locking screw 2, an optional identity sleeve 3, a contact plug 4, a locking plunger 5 and an "O"-ring 6.

FIGS. 2*a*, 2*b* and 2*c* show details of the main body 1. From the main body, there extends a plug portion 202 which is diametrically slotted over an outer portion of the length thereof to form four tines 204. The plug portion 202 is provided with a bore 206 whose outer end is tapered as at 208 to cooperate with a locking plunger to be described hereinafter. The major portion of the main body is provided with a bore 210, a portion of the outer end of which is internally threaded as at 212 to cooperate with a locking screw to be described hereinafter.

The main body 1 is provided with a first radially disposed aperture 214 and a second radially disposed aperture 216 which is of relatively smaller diameter to the aperture 214 and slightly longitudinally offset with relation to aperture 214. Apertures 214 and 216 are provided for receiving a cable to be clamped (not shown). A middle portion of the outer surface of the main body 1 may be provided with a knurled finish at 220 in FIG. 2*a*.

The aforementioned locking plunger will be described with reference to FIGS. 5*a* and 5*b*. The plunger 5 is provided with a pair of spaced apart flanges 502, 504 at one end thereof and a taper 506 at the opposite end thereof and a major cylindrical portion 500 intermediately disposed. Between the flanges 502, 504, there may be disposed an "O"-ring 6 as indicated in FIG. 1.

FIGS. 3*a* and 3*b* provide details of the locking screw 2 previously indicated in FIG. 1. The locking screw 2 is provided with a threaded portion 302 at one end thereof and a knurled portion 304 at the opposite end thereof. The threaded portion of the screw is for reception in the internally threaded portion 212, shown in FIG. 2*b*.

The contact plug 4 in FIG. 1 is shown in more detail in FIGS. 4*a* and 4*b* and comprises a simple cylinder of metal 400 for slidable reception in the bore 210 shown in FIG. 2*b*.

Clockwise rotation of the locking screw 2 causes its threaded portion 302 to interact with the threaded portion 212 in such a fashion that the locking screw 2 is drawn into the main body 1 via the bore 210. As the locking screw 2 is drawn into the main body 1, it forces the contact plug 4 to slide through bore 210 towards the locking plunger 5 until the contact plug 4 makes contact with a cable that is transversely inserted through apertures 214 and 216 between contact plug 4 and locking plunger 5. Further, clockwise rotation of the locking screw 2 causes the cable to be locked between the contact plug 4 and flange 502 of the locking plunger 5, and simultaneously forces the locking plunger 5 into the plug portion 202 via bore 206 to effect the expansion of the tines 204.

An optional feature of the banana plug may include a cable identification sleeve 3 as shown in FIG. 1 which preferrably may be received in a recess 218 as indicated in FIGS. 2*a* and 2*b*. However, it has been found that the recess 218 may be disposed at the end of the main body 1, and otherwise imprinted or marked with alternative identification.

With the exception of the "O"-ring 6, all of the aforementioned items may be formed of metal of which copper, brass or aluminium are typical. It has been found that electrical reliability and attractiveness are enhanced by plating all metallic parts. In one embodiment, the metallic parts are first plated with 10 micro inches of silver over which is deposited 5 micro inches of gold. The sleeve 3 may be formed from a stretchable material, for example, a heat shrinkable material. Alternatively, the sleeve may include a break therein to permit fitting into said recess 218.

Other embodiments of the invention will become apparent to those skilled in the art without departing from the spirit or scope of the appended claims.

The embodiments of the invention in which an exclusive property or privilege is claimed are defined as follows:

1. A self-locking electrical banana plug comprising a main body member having an expandable plug member at one end, said main body member including a hollow portion, a locking plunger for expanding said plug member, a contact plug disposed in said hollow portion of said main body and abutting said locking plunger, cable receiving and cable clamping means disposed intermediately between the ends of said main body member, said cable receiving and cable clamping means comprising at least one cable receiving aperture in a sidewall of said main body member, whereby, in use, a cable end is received in said cable receiving aperture and is disposed between the contact plug and locking plunger, said banana plug further comprising locking means at the other end of said body member, said locking means, in operation, simultaneously effecting expansion of said expandable plug member and activating said cable clamping means.

2. A banana plug as in claim 1 wherein a portion of said expandable plug member is provided with radial slots to define a plurality of resilient and outwardly deformable sectors.

3. A banana plug as in claim 1 wherein said main body member hollow portion is internally threaded adjacent said other end.

4. A banana plug as in claim 3 wherein said expandable plug member includes a hollow portion, which hollow portion has an open end communicating with the hollow portion within said main body member.

5. A banana plug as in claim 3 wherein said body member is provided with first and second cable receiving apertures on opposite sides thereof.

6. A banana plug as in claim 2 wherein said hollow portion within said plug member is provided with a tapered end and wherein said first end of said locking plunger is provided with a similarly proportioned tapered end, said locking plunger, in operation, cooperating with said tapered end within said expandable plug member to effect deformation of the said sectors on said plug member upon longitudinal movement of said plunger into said expandable plug member.

7. A banana plug as in claim 6 wherein said locking means comprises a manually rotatable threaded member for reception in and cooperation with said internally threaded portion in said main body member.

8. A self-locking electrical banana plug for reception in an associated jack and for removably receiving an electrical conductor, said banana plug comprising:

(i) a main body member open at one end and having a coaxial banana plug portion at the opposite end, an internal thread extending inwardly from said open end for a minor portion of the said main body member and a pair of substantially radially aligned cable receiving apertures, said plug portion being hollow over a major portion thereof and the said hollow portion being terminated with a conically-shaped end, the plug portion being radially slotted to define a plurality of outwardly deformable sectors;

(ii) a longitudinally movable locking plunger for reception within said plug portion and said main body member, said plunger having a conical first end for cooperation with said conically-shaped end of said plug portion, the other end having a pair of spaced apart flanges;

(iii) a manually rotatable locking screw having an external thread at one end thereof for cooperation with said internal thread in said main body member and a finger engageable portion at the other end thereof, said locking screw selectively urging said locking plunger into said plug portion thereby to outwardly deform said plurality of sectors.

9. The banana plug as claimed in claim 8, further including a plug disposed between said locking screw and said locking plunger.

10. The banana plug as claimed in claim 8, further including a resilient "O"-ring disposed between said pair of axially spaced apart flanges.

11. The banana plug as claimed in claim 8, further including a polarity identity means on the surface of said main body member.

12. The banana plug as claimed in claim 8, wherein said pair of substantially radially aligned apertures are defined by holes of differing diameters.

13. The banana plug as claimed in claim 8, further including a knurled portion on the outer surface of said main body member.

14. The banana plug as claimed in claim 8 wherein said finger engageable portion is provided with a knurled portion.

15. The banana plug as claimed in claim 11, wherein said polarity identity means comprises an axially extending groove in said main body member for the reception of an identity sleeve.

16. A self-locking electrical banana plug for reception in associated jack and for removably receiving an electrical conductor, said plug comprising:

a main body member open at one end and having a coaxial banana plug portion at the opposite end and further defining at least one cable receiving aperture in a sidewall thereof;

said plug portion being hollow over a major portion thereof, the plug portion being radially slotted in its end to define a plurality of outwardly deformable sectors;

a longitudinally movable locking plunger means for reception within said plug portion and said main body member, said locking plunger means having a first end to cooperate with said plug portion and a second end having a flange portion located within said main body member;

a locking screw means fixedly mounted on said main body portion, said locking screw means selectively urging said locking plunger means by its flange portion into said plug portion thereby to outwardly deform said plurality of sectors, and wherein the end of a cable received in said aperture is disposed between said flange portion and said locking screw means.

* * * * *